US007181890B2

(12) United States Patent
Nuetzel

(10) Patent No.: US 7,181,890 B2
(45) Date of Patent: Feb. 27, 2007

(54) ANCHORING DEVICE FOR A CORROSION-RESISTANT TENSION MEMBER, PARTICULARLY AN INCLINED CABLE FOR A CABLE-STAYED BRIDGE

(75) Inventor: Oswald Nuetzel, Munich (DE)

(73) Assignee: Dywidag-Systems International GmbH, Aschheim (DE)

( * ) Notice: Subject to any disclaimer, the term of this patent is extended or adjusted under 35 U.S.C. 154(b) by 150 days.

(21) Appl. No.: 10/956,028

(22) Filed: Oct. 4, 2004

(65) Prior Publication Data

US 2005/0066595 A1 Mar. 31, 2005

Related U.S. Application Data

(63) Continuation of application No. PCT/EP03/03428, filed on Apr. 2, 2003.

(30) Foreign Application Priority Data

Apr. 3, 2002 (DE) ..... 202 05 149 U

(51) Int. Cl.
*E04C 5/08* (2006.01)

(52) U.S. Cl. ..... 52/223.13; 52/231; 52/223.14

(58) Field of Classification Search ..... 52/223.13, 52/231, 223.14; 14/22
See application file for complete search history.

(56) References Cited

U.S. PATENT DOCUMENTS 4,367,568 A * 1/1983 Weiser ..... 24/122.6
4,484,425 A * 11/1984 Muller ..... 52/223.13
4,594,827 A * 6/1986 Finsterwalder ..... 52/223.13
4,640,068 A * 2/1987 Jungwirth et al. ..... 52/223.13
4,878,327 A * 11/1989 Nutzel et al. ..... 52/223.13
5,493,828 A * 2/1996 Rogowsky et al. ..... 52/223.13
6,578,329 B1 6/2003 Stubler et al.
7,010,824 B2 * 3/2006 Stubler et al. ..... 14/22
2002/0088105 A1 7/2002 Nutzel

FOREIGN PATENT DOCUMENTS

DE 36 44 551 A 1/1988
DE 37 34 954 A1 4/1988

(Continued)

*Primary Examiner*—Naoko Slack
*Assistant Examiner*—Chi Q. Nguyen
(74) *Attorney, Agent, or Firm*—McGrath, Geissler, Olds & Richardson, PLLC

(57) ABSTRACT

An anchoring device for a corrosion-protected tension member includes an anchor body, which is provided with bores for the passage of the tension elements. Sealing discs, which can be compressed by means of a pressure plate and threaded bolts, are provided on a face of the anchor body and lie opposite a downstream face. A perforated disc, which is enclosed by two supporting discs, is located downstream of the sealing discs and the pressure plate. The perforated disc acts as a spacer for the tension elements and is fixed between lugs that are opposite an anchor tube and that is connected to the anchor body. The locking of the perforated disc enables the position of the tension elements to remain parallel, even when the sealing discs are compressed to activate the seal. If individual tension elements have to be replaced, the loosening of the threaded bolts allows the sealing discs to "breathe" and to return to their original position.

20 Claims, 3 Drawing Sheets

FOREIGN PATENT DOCUMENTS

| | | | |
|---|---|---|---|
| DE | 38 31 518 | A | 4/1990 |
| DE | 41 18 897 | A | 12/1992 |
| EP | 0323285 | A | 7/1989 |
| EP | 0 703 326 | A1 | 3/1996 |
| WO | WO 99/36641 | | 7/1999 |
| WO | WO-01/20098 | A | 3/2001 |

* cited by examiner

ANCHORING DEVICE FOR A CORROSION-RESISTANT TENSION MEMBER, PARTICULARLY AN INCLINED CABLE FOR A CABLE-STAYED BRIDGE

This nonprovisional application claims priority to International Application PCT/EP03/03428, which was filed on Apr. 2, 2003, and which claims priority to German Patent Application No. DE 202 05 149.8, which was filed in Germany on Apr. 3, 2002, both of which are herein incorporated by reference.

BACKGROUND OF THE INVENTION

1. Field of the Invention

The present invention relates to an anchoring device for a corrosion-resistant tension member, particularly an inclined cable for a cable-stayed bridge having a plurality of tension elements such as steel rods, steel wires, or steel strands, which are arranged inside a tube-shaped sheath. The tension elements are embedded in a corrosion-resistant substance, with each being arranged in a plastic sheath. Each anchoring device has an anchor body, which is provided with bores for the tension elements to pass through. To a side of the anchor body that is opposite from the exposed side, at least one sealing plate is attached, through which the tension elements are threaded, and next to which a perforated disk is arranged that serves as a spacer for the individual elements.

2. Description of the Background Art

With conventional tension members, so-called monostrands are frequently used as tension elements, that is, strands made of seven steel wires, each being arranged inside a sheath made of plastic, for example, polyethylene, and which are embedded in a corrosion-resistant substance, for example, grease, that fills the cavities between the wires and the ring space between the strand and the sheath. The anchorage of the strands usually includes anchor plates made of steel, with conical, and subsequently cylindrical bores, through which the strands are threaded and in which they are anchored with multiple-part ring wedges. To anchor the strands, it is, however, always necessary to expose the strands in the area of the anchorage by removing the sheaths, so that the anchorage wedges can directly grip the strands.

With a known anchoring device of this kind, the sheaths extend into an anchor pot that is filled with a corrosion-resistant substance, the bottom of the anchor pot having a multitude of openings, the number of openings being equal to the number of strands, through which the strands with their sheaths are fed (DE-A-37 34 954). There is no seal provided because the cavity outside the anchor pot and inside the anchor tube is filled in with cement mortar.

In order to seal off the cavity in the anchoring area, which is to be filled with a corrosion-resistant substance, as tightly as possible against the cavity in the exposed area of the tension member, when it is not going to be filled with hardened material, for example, cement mortar, it is known to arrange a sealing plate that is made of an elastic, ductile material, for example, Neoprene, on the side of the anchor plate that is opposite of the exposed side (EP 0 703 326 B1). The individual strands in their sheaths are threaded through a perforated disk, which serves as a spacer, and the sealing plate to, that is, through the anchor plate so that the corrosion-resistant substance enclosing the strands inside their sheaths directly connects with the material that fills the bores in the anchor plate.

With threaded bolts, which extend through the anchor plate, the sealing plate, and the perforated disk, which follows thereafter, a surface pressure is applied to the sealing plate via the perforated disk that, due to the lateral deformation of the sealing plate resulting therefrom, causes the sealing off of the cavity against the sheaths of the strands.

With this arrangement, not only the sealing plate but also the plastic perforated disk are compressed; a three-dimensional stress condition is created with the result, that the sealing plate is deformed plastically in a lateral direction, thus enclosing the strands firmly. Due to a buckling of the sealing plate and a shifting connected therewith, the perforated disk at the same time changes its position in the direction of the anchor plate; this also causes a repositioning of the reversing point of the strands, which have to be returned from an expanded position towards the anchorage to its former parallel position.

When individual strands need to be replaced, their tension must be decreased. Before loosening the ring wedges of the strands, the threaded bolts, which compress the perforated disk, the sealing plate, and the anchor plate, must be loosened. Due to both, the lateral deformations that took place and the effect of the reversing forces of the strands on the perforated disk, but also as a result of age-related shifting of the plastic material, the perforated disk cannot return to its original position, when the surface pressure on the plates decreases after the threaded bolts are loosened, without additional expenditure of energy; even less so since in this case, the tube-shaped sheath in the area adjacent to the anchor plate is an anchor tube of conical shape corresponding to the expansion of the strands towards the anchor plate. Therefore, a replacement of individual strands requires the dismantling of the entire anchor plate; otherwise there is the danger that the deformed sealing plate is damaged when the strands are pulled.

SUMMARY OF THE INVENTION

It is therefore an object of this invention to provide a simpler and more economical means for a seal of an anchoring area of a tension member of this kind, which allows sealing plates to breathe without additional expenditure of energy, and thus a more simplified replacement of individual strands.

A primary benefit of the invention is that the sealing plates are compressed by an additionally arranged pressure plate, and are thus put into a three-dimensional state of tension. Once the perforated disk arranged thereafter is locked in the anchor body, the position of the strands remains parallel even during squeezing and compression of the sealing plates. After the threaded bolts, which extend through the pressure plate, the sealing plates and the anchor plate are loosened, and the sealing plates are able to pass freely through the elastic extension path and return to their original position so that individual strands can be replaced without causing damage to the sealing plates and without having to loosen the entire wedge anchoring, due to the cylindrical shape of the anchor tube.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
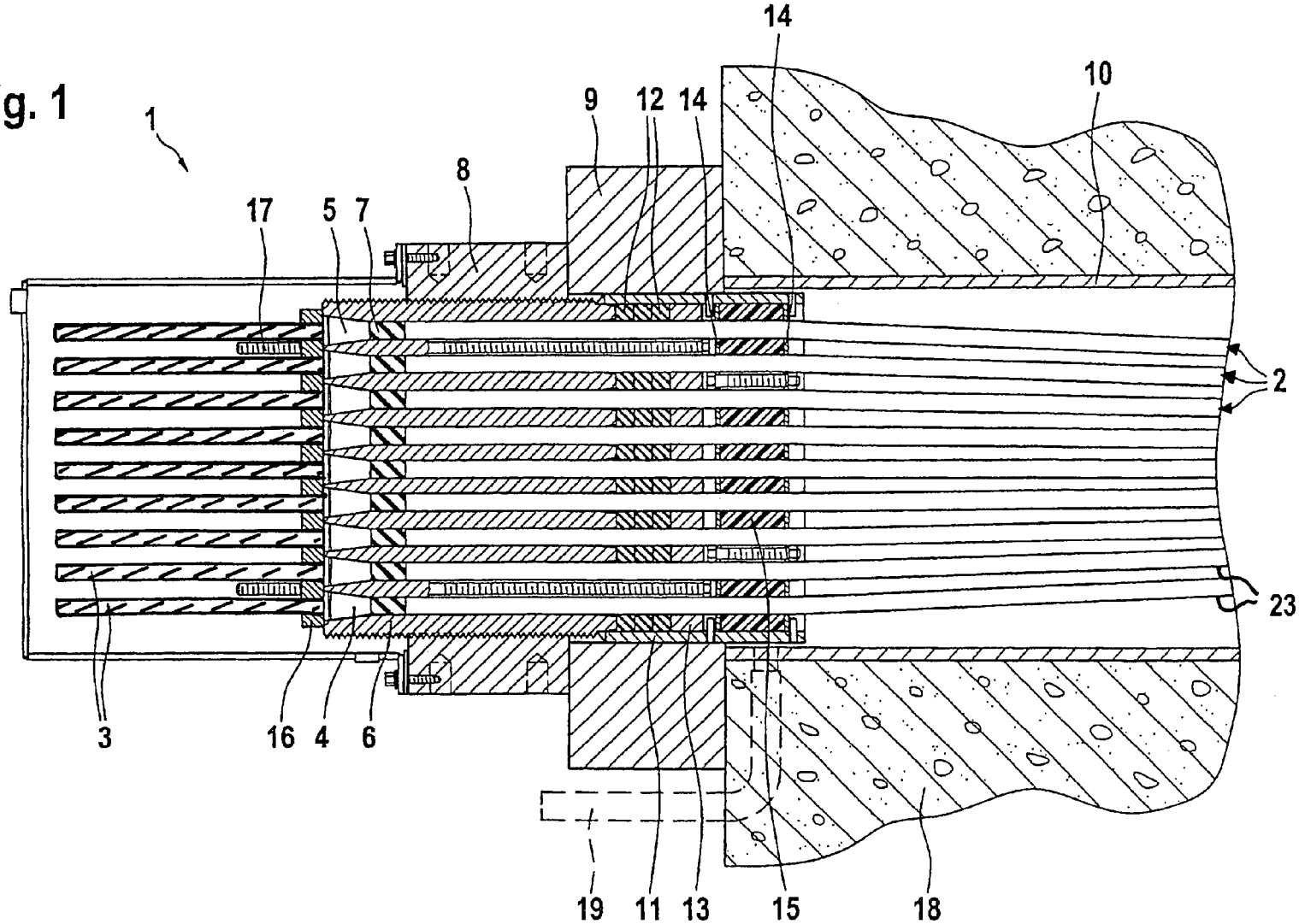
FIG. 1 is a longitudinal cross-section of the anchoring area of a tension member according to a preferred embodiment of the invention, prior to compression of sealing plates.
Figure 2:
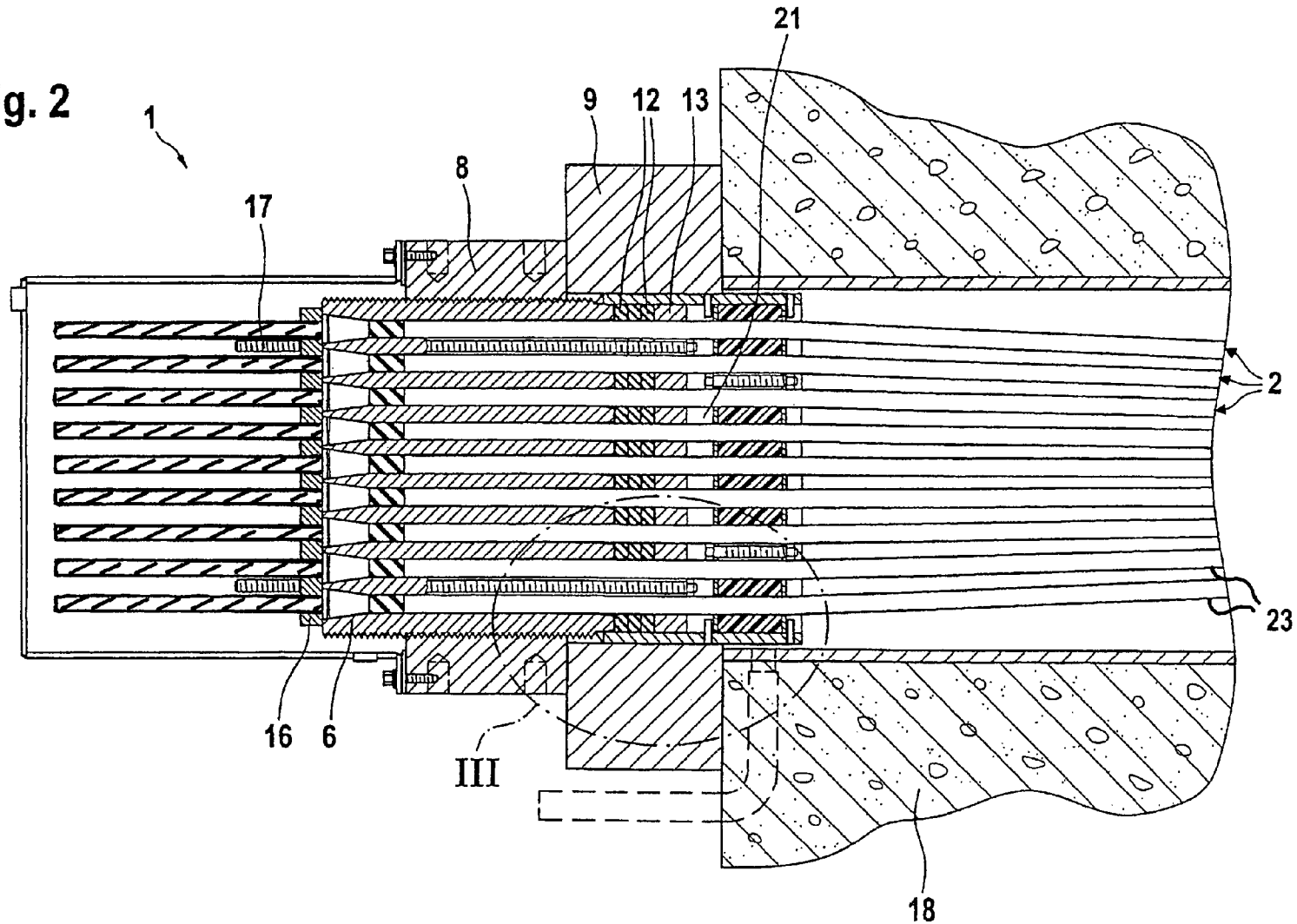
FIG. 2 is a longitudinal cross-section as in FIG. 1, after compression of the sealing plates.

In FIGS. 1 and 2, the respective anchoring area of a tension member of this invention, for example, an inclined cable for a cable-stayed bridge, is illustrated in two different modes of operation.

The tension member anchored to an anchoring device 1 of this invention is comprised of a plurality of individual tension elements 2. The tension elements 2, in turn, are comprised of steel wire strands 3, which are provided with corrosion-resistant plastic sheaths 23, for example, protective hoses. The strands 3 are anchored to an anchor body 6, which can be made of steel, by multi-part ring wedges 4 in initially conical, then cylindrical bores 5.

Next to the ring wedges 4, in the cylindrical area of the bores 5, sockets 7 are arranged, to which the sheaths 23 of the strands 3, which are removed in the anchoring area, abut, and which thus prevent a slipping of the sheaths 23 when the strands 3 are being tightened. The anchor body 6, which is provided with a full-length external thread, is supported via a threaded ring 8, which is provided with a corresponding internal thread, against a steel abutment plate 9, which is adjacent to a concrete construction unit 18, and in a way forms the end piece of a tube-shaped sheath 10 of the tension member 1 therein.

On a structure side, a cylindrical anchor tube 11 is welded to the anchor body 6, inside of which are arranged in sequence—starting from the exposed side in the direction of the structure side—sealing plates 12 and a pressure plate 13 followed by a combination of two support plates 14 and a perforated disk 15 located between the two support plates 14 and serving as a spacer for the tension elements 2. The sealing plates 12 can be made of an elastic, ductile material, for example, Neoprene, and the perforated disk 15 can be made of plastic, for example, PE (polyethylene), whereas, the pressure plate 13 and the support plates 14 can be made of steel.

Towards the exposed side, the ring wedges 4 are additionally secured by a wedge lock plate 16, which is provided with a number of bores corresponding to the number and diameter of the strands 3. Threaded bolts 17 extend through the wedge lock plate 16, the anchor body 6, as well as the sealing plates 12 and the pressure plate 13. By tightening the bolts 17 from the exposed side, the sealing plates 12 are compressed, whereby they expand in a transverse direction and tightly enclose the tension elements 2. In this way, the anchoring area of the tension member 1 is sealed off against the structure side.

Possible condensation accumulating inside the sheath 10 can be drained via an opening 19.

The perforated disk 15, which is made of Polyethylene, serves as a spacer in between the individual tension elements 2. The support plates 14, in between which the perforated disk 15 is sandwiched, prevent age-related shifting of the perforated disk 15 due to reversing forces being directed inwardly as a result of the expansion of the tension elements 2. The combination of the perforated disk 15 and the two support plates 14, which are held together by threaded bolts 22, is locked inside the tube 11 by lugs 20.

FIG. 2 shows the anchoring area of the tension member, as already illustrated in FIG. 1 in an installation mode, with the sealing plates 12 being in a state of deformation. Due to the fact that the pressure plate 13 is freely slidable inside the cylindrical anchor tube 11, and that the combination of support plates 14 and the perforated disk 15, which is sandwiched in between, is locked by lugs 20, a gap 21 is created in the anchor tube 11 after the threaded bolts 17 are tightened, which corresponds with the elastic extension path of the material of the sealing plates 12. Around this extension path, the sealing plates 12 can "breathe" after the threaded bolts are loosened. This causes the loosening of the tight enclosure of the individual tension elements 2 by the sealing plates 12 so that individual tension elements 2 can be replaced.

Figure 3:
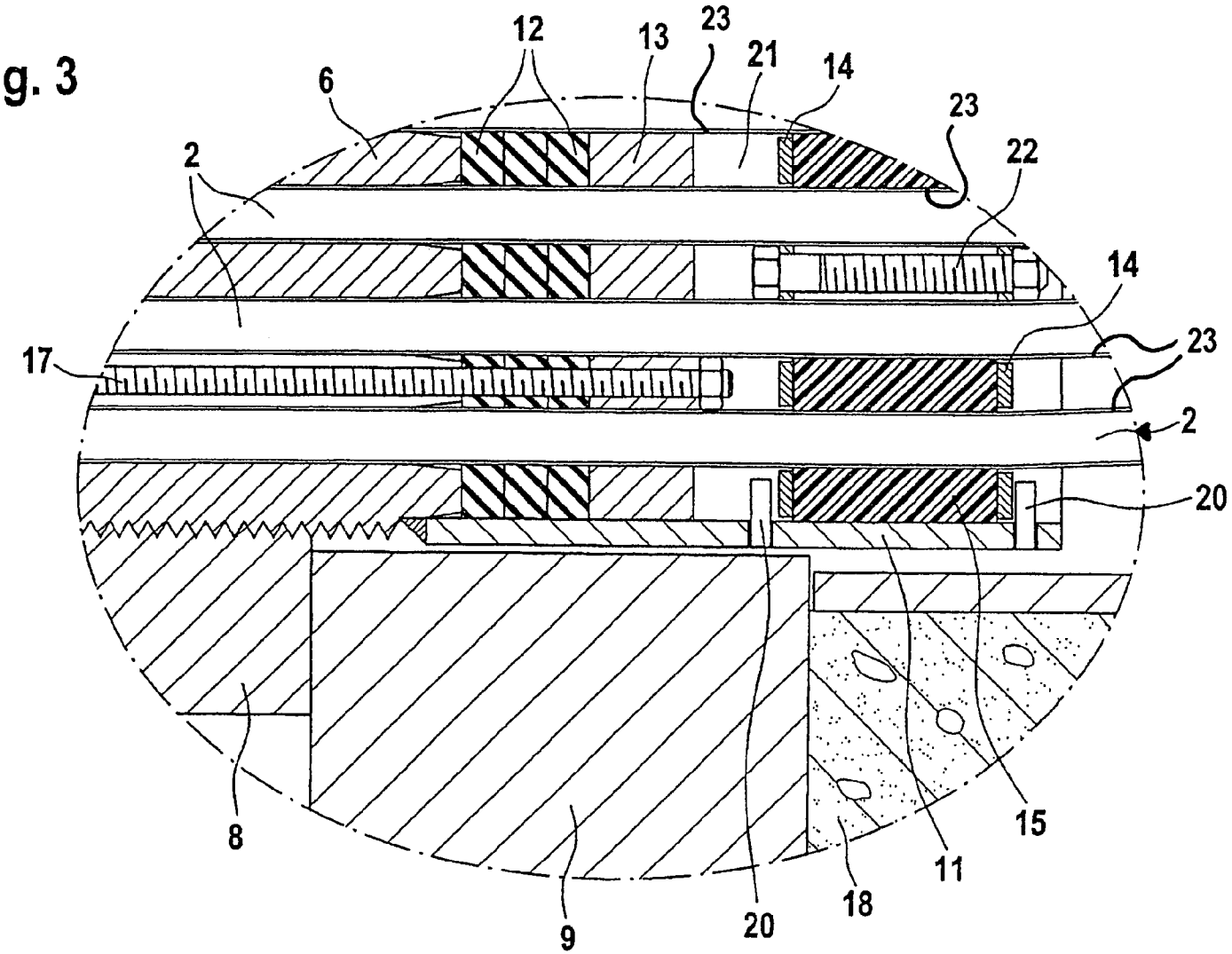
FIG. 3 is an enlarged illustration I of a portion of FIG. 2.

FIG. 3 shows an enlarged detail I of FIG. 2. In particular, it illustrates one of the threaded bolts 17 acting against the pressure plate 13 and compressing the sealing plates 12; furthermore, the threaded bolts 22, which hold together the combination of the support plates 14 and the perforated disk 15 that is sandwiched in between. Also shown are the two lugs 20, which are fixed in place opposite the cylindrical anchor tube 11, for example, with set-screws, between which the combination of support plates 14 and perforated disk 15 is locked in place. Easily recognizable is also the cavity 21, which was created by the elastic deformation of the sealing plates 12, in which the sealing plates can "breathe," if necessary, after the threaded bolts 17 are loosened.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An anchoring device for a corrosion-resistant tension member, the anchoring device comprising:

a plurality of tension elements that are arranged inside a tube-shaped sheath, the tension elements being embedded in a corrosion-resistant substance with each being arranged in a plastic sheath;

an anchor body that is provided with bores for the tension elements to pass through; and at least one sealing plate, through which the tension elements pass through, is adjacent to a side of the anchor body that is opposite an exposed side of the anchoring device, and next to which a perforated disk, which functions as a spacer, is arranged, wherein the at least one sealing plate is pressed against the anchor body by a pressure plate, which is arranged between the sealing plate and the perforated disk.

2. The anchoring device according to claim 1, wherein the at least one sealing plate is made of an elastic, ductile material, and is compressable by threaded bolts, which extend through the sealing plate as well as the pressure plate and the anchor body.

3. The anchoring device according to claim 1, wherein, in an area adjacent to the anchor body, the tube-shaped sheath is a cylindrical anchor tube.

4. The anchoring device according to claim 3, wherein the anchor tube is a steel tube.

5. The anchoring device according to claim 4, wherein the anchor tube is welded to the anchor body.

6. The anchoring device according to claim 1, wherein the perforated disk is secured against longitudinal displacement towards the anchor tube.

7. The anchoring device according to claim 1, wherein, adjacent to at least one side of the perforated disk, there are support plates that are provided with corresponding bores, of which at least one can be supported against the anchor tube.

8. The anchoring device according to claim 7, wherein the support plates abut to both sides of the perforated disk, and wherein the perforated disk can be compressed via threaded bolts that are screwed through the perforated disk and the support plates.

9. The anchoring device according to claim 8, wherein a combination of the perforated disk and the support plates can be secured against longitudinal displacement between lugs that rise towards an interior of the anchoring device from walls of the anchor tube.

10. The anchoring device according to claim 1, wherein the corrosion-resistant tension member is an inclined cable for a cable-stayed bridge.

11. The anchoring device according to claim 1, wherein the plurality of tension elements are steel rods, steel wires, or steel strands.

12. An anchoring device comprising:

an anchor body having a plurality of bores being provided on a first end of the anchor body, the plurality of bores each enabling a tension element to pass therethrough;

a sealing plate being arranged adjacent to a second end of the anchor body;

a perforated disk providing for a predetermined space between the tension elements;

a pressure plate for applying pressure to the sealing plate, the pressure plate being provided between the sealing plate and the perforated disk.

13. The anchoring device according to claim 12, wherein the anchor body is fixedly attached to an anchor tube, the anchor tube being formed so as to contain the sealing plate, the perforated disk, and the pressure plate therein.

14. The anchoring device according to claim 12, wherein the perforated disk is provided between a first support plate and a second support plate.

15. The anchoring device according to claim 14, wherein the first support plate and the second support plate directly abut a first side and a second side of the perforated disk, respectively.

16. The anchoring device according to claim 12, wherein a gap is formed between the pressure plate and the perforated disk.

17. The anchoring device according to claim 12, wherein the pressure plate directly abuts the sealing plate.

18. The anchoring device according to claim 12, wherein the sealing plate directly abuts the second end of the anchor body.

19. The anchoring device according to claim 12, wherein the sealing plate deforms when pressure is applied by the pressure plate.

20. The anchoring device according to claim 12, wherein the sealing plate, the perforated disk, and the pressure plate are formed so as to enable the tension elements to pass from the plurality of bores to a downstream end of an anchor body.

* * * * *